US005475945A

United States Patent [19]

Baker

[11] Patent Number: 5,475,945

[45] Date of Patent: Dec. 19, 1995

[54] WINDOW STOP

[76] Inventor: John R. Baker, 845B Stanley Ave., Evansville, Ind. 47711

[21] Appl. No.: 327,572

[22] Filed: Oct. 24, 1994

[51] Int. Cl.[6] ..... E05B 55/00

[52] U.S. Cl. ..... 49/449; 292/238

[58] Field of Search ..... 49/449; 292/DIG. 20, 292/238

[56] References Cited

U.S. PATENT DOCUMENTS

| | | | |
|---|---|---|---|
| 2,201 | 3/1866 | Gaasbeek | 292/238 |
| 288,611 | 11/1883 | Asimont | 292/238 |
| 301,804 | 7/1884 | Chevremont | 292/DIG. 20 |
| 632,217 | 8/1899 | Getchell | 292/238 |
| 1,398,174 | 11/1921 | Carlson | 292/DIG. 20 |
| 2,129,957 | 9/1938 | Pearson | 292/238 |
| 2,202,561 | 5/1940 | Lahiere et al. | 292/238 |
| 2,496,698 | 2/1950 | Chapman | 292/DIG. 20 |
| 2,500,044 | 3/1950 | Riddell | 292/DIG. 20 |
| 3,288,509 | 11/1966 | Galena | 292/238 |

*Primary Examiner*—Brian K. Green
*Assistant Examiner*—Jerry Redman

[57] ABSTRACT

This invention is a mechanism that when installed in a window casement provides an inner strip having a catch which holds a raised window in the open position.

2 Claims, 1 Drawing Sheet

WINDOW STOP

BACKGROUND—FIELD OF INVENTION

This invention relates to a simple mechanism for holding a window in a raised position. It replaces sash cords and counterweights that are often used to hold windows in a raised position. In older homes, the sash cords often break. In such cases, the householder either must repair the sash cord, which necessitates some time and effort, or use some means of propping up the window, such as a board. Newer homes have windows with track arrangements for holding the windows in a raised position. Over time, these tracks wear, and then the same problem of holding a window raised occur. This invention is a useful alternative in such cases.

BACKGROUND—DESCRIPTION OF PRIOR ART

This inventor during his career in residential construction and remodeling has never seen anything like this. It was invented because it is a needed device. In older homes, where the sash cord is broken, and the counterweight no longer serves its intended function, people usually don't repair the sash cord and counterweight. The usual practise is to hold the window in a raised position with a board. There have been sad accidents where young children at play have been injured by the weight of a falling window after knocking a board used as a window prop out of position. This invention is a useful alternative to the current approach to using a sash cord and counterweight to hold a window raised or, that failing, a prop such as a board or stick to hold the window raised. This invention is also useful when the window track systems in newer homes have worn to the point of no longer holding the windows in position.

SUMMARY

This invention is a simple clip assembly that attaches to a window casement in such a way that when the window is raised, one part of the clip, called the outer strip, is rotated into position so that the window is held in a raised position. When it is desired to close the window, the window is raised sufficiently to permit the aforesaid outer strip to be rotated back into its original vertical position, and then the window can be lowered. This is an alternative to the current sash and counterweight approach. It is also an alternative to using a board to hold the window when the window's sash and counterweight assembly no longer is functional. The simple clip assembly consists of two metal strips held together in such a manner that the outer strip can rotate with respect to the inner strip. The inner strip has a catch that holds the outer strip in a horizontal plane such that the window will rest against, and be prevented from further descent by, the aforesaid outer strip. The clip assembly is secured in position near the window by means of fasteners through the innerstrip into the window casement. There is a spacer option in the event the clip has to clear a metal track or guide in the casement .adjacent to the window.

REFERENCE NUMERALS IN DRAWING

1. outer strip
1A. outer strip aperture
2. inner strip
2A. inner strip aperture
2B. inner strip chamfered aperture
2C. catch
3. spacer

3A. clearance
3B. spacer aperture
4. clip assembly fastener
5. mounting fasteners
10. clip assembly

DRAWINGS

FIG. 1. Clip assembly 10 with outer strip 1 perpendicular to inner strip 2, resting against catch 2C.

FIG. 2. Clip assembly 10 with outer strip 1 parallel to inner strip 2.

FIG. 3. Clip assembly 10 shown mounted in a window casement holding the window open.

FIG. 4. Exploded view of invention.

DETAILED DESCRIPTION WITH RESPECT TO DRAWINGS

Figure 3:
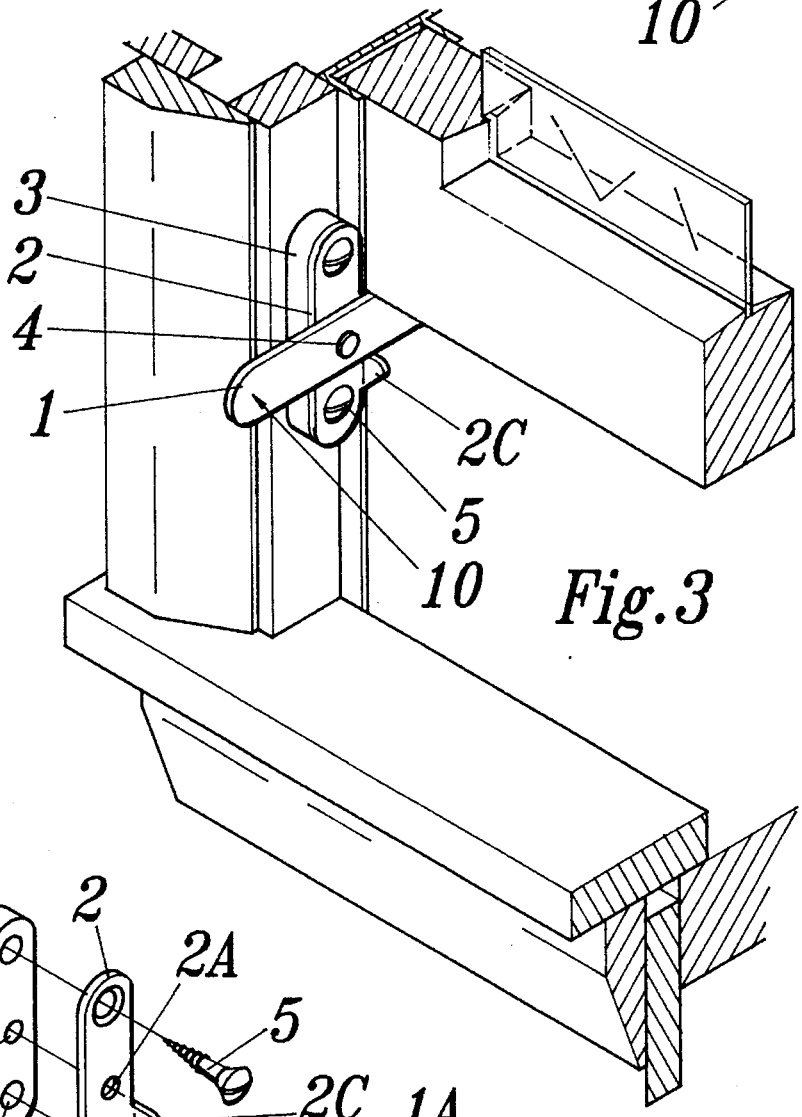

Referring to FIG. 3, a clip assembly 10 is shown installed, holding a window in the open position.

Figure 1:
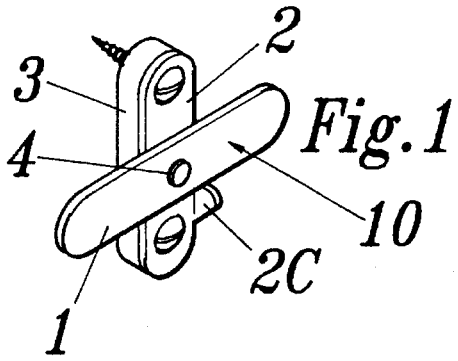

Referring to FIG. 1, the clip assembly 10 is shown in the same mode as in FIG. 3, but independent of the window.

Figure 2:
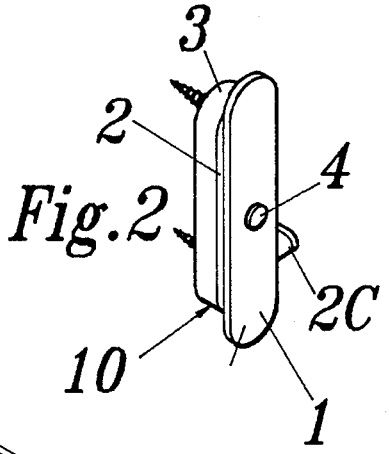

Referring to FIG. 2, the clip assembly 10 is shown in the position it would be when not in use.

Figure 4:
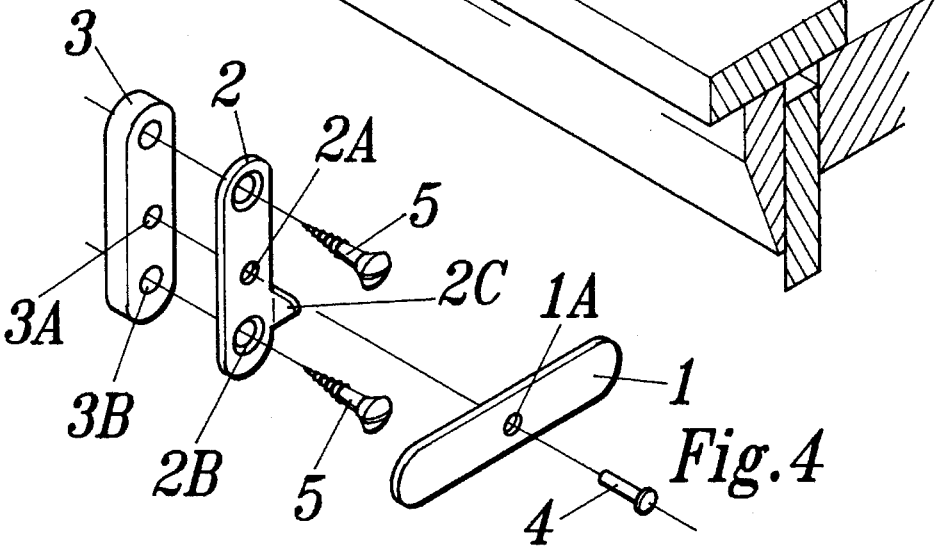

Referring to FIG. 4, for the exploded view, one can see the pieces of the invention. There are two metal strips, an outer strip 1 and an inner strip 2. The outer strip 1 and the inner strip 2 are held together by a clip assembly fastener 4 inserted through an outer strip aperture 1A in the aforesaid outer strip 1, and also through an inner strip aperture 2A in the aforesaid inner strip 2. The inner strip 2 also has inner strip chamfered apertures 2B as well as a catch 2C.

The preferred embodiment of the clip assembly fastener 4 is a flat head rivet on one end and an orbital spun rivet head on the other end. It is important that the clip assembly fastener 4 securely fasten the outer strip 1 and the inner strip 2 together in such a manner as to accomplish the intended structural purpose of holding a window in a vertical position, yet the outer strip 1 must freely rotate with respect to inner strip 2, except where physically stopped by the catch 2C. Orbital spun rivet heads in the past have accomplished this in automotive rachet bumper jacks. However, there are equivalent ways to do it, obvious to those skilled in the art. There is a spacer 3 which is a desirable option in those cases where the clip assembly 10 needs to be offset from the casement surface to clear a window track or channel that is present in some window casement assemblies. The spacer 3 includes spacer apertures 3B as well as a clearance 3A. The purpose of the clearance 3A is to provide clearance for the adjacent end of the clip assembly fastener 4. The assembly comprised of the outer strip 1, the inner strip 2, and the clip assembly fastener 4 is mounted to a window casement by means of the mounting fasteners 5 which pass through the aforementioned inner strip chamfered apertures 2B. If the spacer 3 is required, the mounting fasteners also pass through the aforesaid spacer apertures 3B. The aforesaid assembly comprised of the outer strip 1, the inner strip 2, and the clip assembly fastener 4, mounted to a window casement by means of the mounting fasteners 5, with the spacer 3, is shown as a clip assembly 10 in FIG. 3.

The clip assembly 10, in FIG. 3 is shown with the outer strip 1 rotated against the catch 2C of inner strip 2. This serves to hold the window in the vertical position as determined by the vertical placement of the clip assembly 10.

To close the window, one merely lifts the window sufficiently to permit rotation of the outer strip 1 to a vertical position, as shown in FIG. 2, and then the window can be lowered.

In the embodiment shown, the clip assembly 10 is mounted on the left side of the window. This is for the convenience of right handed window openers, who might tend to want to hold the window with their right hand while they actuate the clip assembly 10 with the left hand.

In the embodiment shown, for a right side mount, only a change to the inner strip 2 would be required of the components of clip assembly 10. This is obvious to anyone skilled in the art.

Referring to FIG. 2, the outer strip 1 is shown longer than the inner strip 2 to facilitate manually rotating the outer strip 1 with respect to the inner strip 2. Alternate embodiments, obvious to anyone skilled in the art would be an outer strip 1 with the outer strip aperture 1A located at one third the distance from one of the ends, as opposed to the middle of the outer strip 1 as is shown in the FIG. 1 through 4. If the resulting long end was under the window, the short end would provide more clearance, if required, for adjacent blinds. If the short end were under the window, when the window was raised, and if the clip assembly fastener 4 gave sufficient clearance between outer strip 1 and the inner strip 2, the outer strip 1 would tend to naturally rotate into a vertical position, permitting a one handed person to raise and then lower the window. Or, a person, in such a case, is free to use both hands to control the window while the outer strip 1 of the clip assembly 10 falls naturally into position such that the window can then be closed.

In the preferred embodiments shown, metal is the preferred material, except the spacer 3 could be of a variety of materials.

Although the description above contains many specificities, these should not be construed as limiting the scope of the invention but as merely providing illustrations of some of the presently preferred embodiments of this invention.

I claim:

1. A means of holding a window in a raised position, said means comprised of:

an outer strip;

an inner strip with a catch (2C) which is a positive stop and holds the outer strip in a horizontal position while said outer strip holds the window at a vertical elevation, and allows the window to rest on said outer strip;

a means of fastening the outer strip to the inner strip to the window casement, in such a manner that the outer strip is free to rotate with respect to the inner strip.

2. A means of holding a window in a raised position, said means comprised of:

an outer strip;

an inner strip with a catch (2C) which is a positive stop and holds the outer strip in a horizontal position while said outer strip holds the window at a vertical elevation, and allows the window to rest on said outer strip;

a means of fastening the outer strip to the inner strip to the window casement in such a manner that the outer strip is free to rotate with respect to the inner strip;

a spacer (3) which off-sets the inner strip from the window casement in such a manner that the outer strip is free to rotate with respect to the inner strip and window casement.

* * * * *